US011732850B2

(12) United States Patent
Talbi

(10) Patent No.: US 11,732,850 B2
(45) Date of Patent: Aug. 22, 2023

(54) SMART RECESSED LIGHT

(71) Applicant: Aziz Talbi, Davenport, IA (US)

(72) Inventor: Aziz Talbi, Davenport, IA (US)

( * ) Notice: Subject to any disclaimer, the term of this patent is extended or adjusted under 35 U.S.C. 154(b) by 0 days.

(21) Appl. No.: 16/845,081

(22) Filed: Apr. 10, 2020

(65) Prior Publication Data

US 2021/0325010 A1 Oct. 21, 2021

(51) Int. Cl.

| | |
|---|---|
| ***F21S 8/02*** | (2006.01) |
| ***F21V 33/00*** | (2006.01) |
| ***F21V 23/06*** | (2006.01) |
| ***F21V 17/00*** | (2006.01) |
| ***F21V 21/096*** | (2006.01) |

(52) U.S. Cl.

CPC ..... *F21S 8/02* (2013.01); *F21S 8/026* (2013.01); *F21V 17/002* (2013.01); *F21V 21/096* (2013.01); *F21V 23/06* (2013.01); *F21V 33/0004* (2013.01)

(58) Field of Classification Search

CPC ..... F21S 8/02; F21S 8/026; F21V 17/002; F21V 21/096; F21V 23/06; F21V 33/0004

See application file for complete search history.

(56) References Cited

U.S. PATENT DOCUMENTS

| | | | | |
|---|---|---|---|---|
| 6,350,046 | B1 * | 2/2002 | Lau | F21V 29/15 362/147 |
| 6,948,831 | B1 * | 9/2005 | Naqvi | F21S 8/02 362/802 |
| 10,113,911 | B2 * | 10/2018 | Coombes | G01J 3/51 |
| 10,808,922 | B1 * | 10/2020 | Hsu | F21S 8/026 |
| 10,900,644 | B1 * | 1/2021 | Steines | F21V 19/0055 |
| 10,977,920 | B2 * | 4/2021 | Nelson | F21V 23/003 |
| 2005/0265016 | A1 * | 12/2005 | Rappaport | F21V 17/105 362/147 |
| 2006/0177088 | A1 * | 8/2006 | Howard | H04R 1/025 381/391 |
| 2007/0253193 | A1 * | 11/2007 | Lau | F21S 8/02 362/147 |
| 2009/0072970 | A1 * | 3/2009 | Barton | H05B 47/11 362/20 |
| 2010/0148672 | A1 * | 6/2010 | Hopper | F21V 23/0442 315/158 |

(Continued)

FOREIGN PATENT DOCUMENTS

| | | | | |
|---|---|---|---|---|
| WO | WO-2018165058 | A1 * | 9/2018 | F21S 8/061 |

*Primary Examiner* — Leah Simone Macchiarolo

(74) *Attorney, Agent, or Firm* — Dykema Gossett PLLC

(57) ABSTRACT

A smart recessed light assembly for mounting into a hollow opening made in ceiling or a wall comprises a light source housing, a trim and a device mounting track. The device mounting track creates an extension to the illuminating assembly to house and power a variety of devices pertaining to smart home like an audio system, a video projection system, a surveillance system, variety of sensory systems that can measure temperature and humidity, to detect motion or hazardous situations like the case for carbon monoxide (CO). Smart recessed light may be recessed into the ceiling to give it the appearance of a continuous surface and to give it an aesthetic appeal. In addition, device mounting track has a modular cover to allow devices to be hidden behind a grid cover like the case of speaker or exposed like the case of a motion detection sensor.

15 Claims, 2 Drawing Sheets

(56) References Cited

U.S. PATENT DOCUMENTS

| | | | | |
|---|---|---|---|---|
| 2010/0246193 | A1* | 9/2010 | Clifton | F21V 15/005 362/365 |
| 2015/0338077 | A1* | 11/2015 | Johnson | H05B 47/19 362/234 |
| 2016/0150135 | A1* | 5/2016 | Chen | H05B 45/20 348/151 |
| 2016/0334082 | A1* | 11/2016 | Chen | H04N 5/2252 |
| 2017/0105632 | A1* | 4/2017 | Chen | H04N 7/183 |
| 2017/0238401 | A1* | 8/2017 | Sadwick | H05B 45/10 315/294 |
| 2018/0091715 | A1* | 3/2018 | Chen | F21V 33/0076 |
| 2019/0075634 | A1* | 3/2019 | Cho | F21V 23/045 |
| 2019/0113220 | A1* | 4/2019 | Haase | F21V 29/713 |
| 2020/0260181 | A1* | 8/2020 | Talbi | F21V 33/0056 |

* cited by examiner

SMART RECESSED LIGHT

CROSS REFERENCE TO RELATED APPLICATION

This application is related to U.S. Provisional Application Ser. No. 62/666,090 filed May 2, 2018.

FIELD OF THE INVENTION

The present invention generally relates to an apparatus, system, and methods for integrating a variety of electrical devices as they pertain to a smart home. More particularly, it relates to a plurality of interconnecting devices and methods to mount and provide electrical power to these devices to perform a variety of useful smart home functions and tasks.

BACKGROUND OF THE INVENTION

More and more focus is given to home automation and new devices that will take smart homes to a new level. A smart home integrates smart devices that are loaded with possibilities to make our day to day lives easier, more convenient, more comfortable, safer and more coherent. These devices are usually interconnected and are installed to enhance automation in the area of lighting controls, audio systems, surveillance systems, sensors like a motion detector, air quality and hazard detector to just name a few.

While a smart home is supposed to automate, simplify, and make the functionality of our living space more efficient, integrating a plurality of smart devices has quickly become more complicated. In addition, adding smart devices to homes can be costly and time consuming since it requires running wires to/from each of these devices and possibly tearing up of walls and ceilings. This is in addition to the need to cutout openings for each device which present an undesirable look. For example, a cutout for recessed lighting, for speakers and smoke detector.

The present invention aims to solve some of these problems by providing a fixture that can facilitate adding and integrating a variety of smart home devices like a light assembly, an audio system, a video projector system, security cameras, sensors and various other attachments in an organized, coherent and stylish fashion.

SUMMARY OF THE INVENTION

Recessed lights, also known as can lights or downlights, are widely used in residential and commercial buildings. They present a practical and attractive option to add lighting to any residential or commercial space. They appeal to home owners and designers for the fact that they are embedded into the hollow opening of a ceiling or a wall and take up less visual space. They also appeal to home owners and designers for the fact that being recessed into ceilings gives the appearance of a continuous surface, and for their aesthetic versatility and appeal.

There are three parts to a recessed lighting fixture: light source housing, trim and bulb. The housing, which can be of different size and shape, is the fixture itself that is installed inside the ceiling and contains lamp socket/holder. The trim is the visible portion of the fixture that is affixed over the opening of the housing.

The present invention generally relates to an apparatus, system, and methods for integrating a variety of electrical devices as they pertain to a smart home. More particularly, it relates to methods of mounting a plurality of devices and providing electrical power to these devices to perform a variety of useful smart home functions and tasks. The methods of mounting and providing power to smart home devices revolve around the embodiment of an illuminating assembly. A variety of different shaped device mounting tracks create an extension to the illuminating assembly to house a variety of devices, for example, an audio system, a video projection system, a surveillance system, variety of sensory systems that can measure temperature and humidity, to detect motion or hazardous situations like the case for carbon monoxide (CO), and air quality testing, anything that can be harmful to humans and/or animals.

DETAIL DESCRIPTION OF THE INVENTION

All illustrations of the drawings are for the purpose of describing selected versions of the present invention and are not intended to limit the scope of the present invention.

Figure 1:
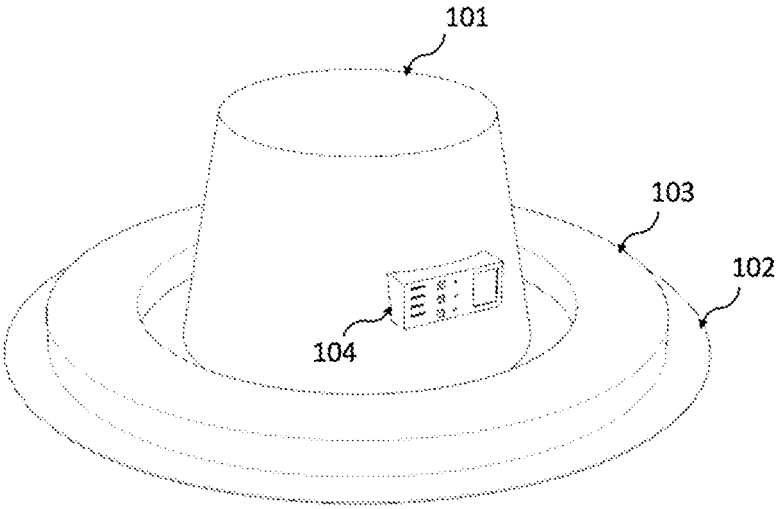
FIG. 1 illustrates an isometric view according to one embodiment of the current invention comprising a circular shaped smart recessed light fixture which item 101 is its canister and a trim is item 102. Item 103 is a device mounting track and item 104 is a smart hub.

In the conceptual illustration of the exemplary embodiment shown in FIG. 1, the Smart Recessed Light can be of circular shape and can serve the purpose of housing, mounting and powering a plurality of devices that pertain to a smart home or building. These devices may be interconnected and may be installed to enhance automation in the area of lighting controls, audio systems, surveillance systems, sensors like a motion detector, air quality and hazard detector to just name a few.

In one embodiment of the current invention, as captured in FIG. 1, a smart recessed light assembly is provided that comprises a canister 101, a trim 102, a device mounting track 103 and a smart hub 104. The device mounting track can be used to house a plurality of devices like a speaker, a smoke detector or a temperature sensor. It may be recessed into the ceiling to give it the appearance of a continuous surface and to give it an aesthetic appeal. In addition, device mounting track has a modular cover to allow devices to be hidden behind a grid cover like the case of speaker 202 or exposed like the case of smoke detector 204.

According to one embodiment of the current invention, a smart recessed light can be installed in new or old residential or commercial buildings. In the case of a new construction, a smart recessed light may be installed like any current recessed light available in the market. In the case of an old construction, the current opening is simply enlarged (as needed) and a new smart recessed light is installed taking advantage of already existing power lines.

Figure 2:
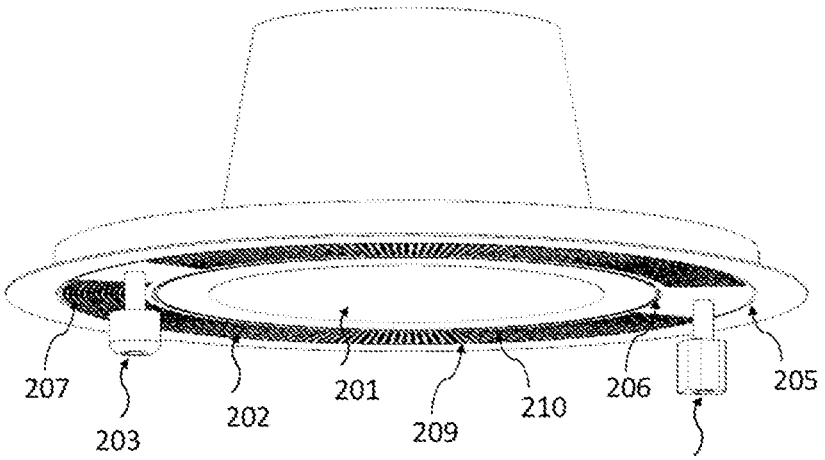
FIG. 2 illustrates an isometric view according to one embodiment of the current invention comprising a light bulb 201, a speaker assembly 202, a temperature sensor 203, a smoke detector 204, a voltage rail 205/206 that can provide power to installed devices, a data rail 209/210 as one mean of establishing communication between devices and a device mounting track cover 207.
Figure 3:
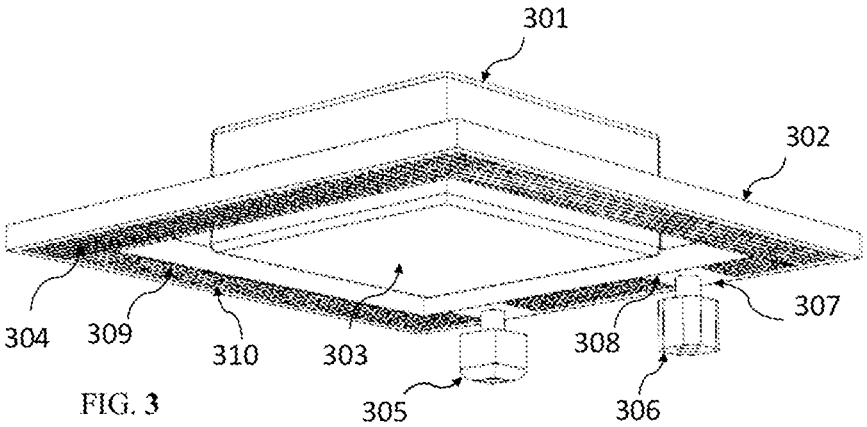
FIG. 3 illustrates an isometric view according to one embodiment of the current invention comprising a square shaped smart recessed light fixture which item 301 is its canister and a trim is item 302. light bulb is item 303, a speaker assembly 304, a temperature sensor 305, a smoke detector 306 and a voltage rail 307/308 that can provide power to installed devices. A data rail 309/310 as one means of establishing communication between installed devices.

In one embodiment of the current invention, as captured in FIG. 2 and FIG. 3, adding and installing a new device, consists of simply removing device mounting track cover 207 or 304, installing the desired device and putting the cover back. In some cases, where a device needs to be exposed, as it is the case for 203, 204, 305 and 306, a cutout can be made on the cover or a section of the cover is left out as the cover is modular.

Furthermore, in one embodiment of the current invention, securing smart devices to device mounting track can be done via mechanical retainers which may include clips and screws. In another embodiment of the current invention, device mounting track is configured to magnetically secure smart devices to device mounting track for easy installation.

Furthermore, in an exemplary embodiment, powering devices can be done via a voltage rail 205/206 in the case of a circular smart recessed light or 307/308 in the case of a square smart recess light. In another embodiment, powering smart devices can also be done via cords connected to the smart hub 104. One function of the smart hub is to serve the purpose of providing some special power needs. Another function of the smart hub can be to consolidate some of the data and signal processing tasks like an analog to digital converter to minimize the size of a smart devices like the case of a smoke detector being bulky.

Furthermore, in an exemplary embodiment, smart devices installed can be interconnected and can share data via a wireless protocol, via a wire connection to the smart hub or via data rail 209/210 in the case of a circular smart recessed light or 309/310 in the case of a square smart recess light.

Figure 4:
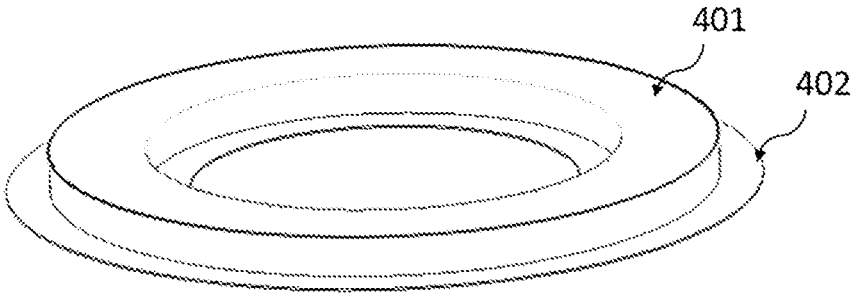
FIG. 4 is an isometric view of a device mounting track that can be used as an add-on to an existing recessed light. Mounting track is item 401 and trim is item 402.
Figure 5:
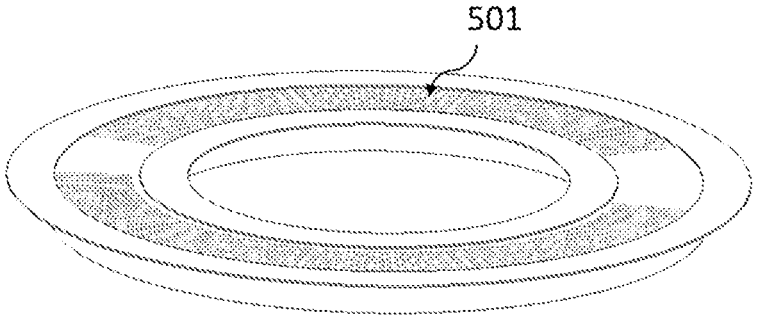
FIG. 5 is another isometric view of a device mounting track that can be used as an add-on to an existing recessed light. Device mounting track cover is item 501.

Furthermore, in an exemplary embodiment, as captured in FIG. 4 and FIG. 5, the device mounting track can also be an add-on to an illuminating assembly for the case of an old construction. In this embodiment, the current recessed light opening is simply enlarged (as needed) and a device mounting track is attached to an existing recessed light. The device mounting track can hangs off a recessed light down from the trim or installed recessed into ceiling or a wall to give the appearance of a continuous surface. This embodiment takes advantage of existing power lines to provide power to device mounting track for easy installation.

What is claimed is:

1. A smart recessed light fixture for mounting into a hollow opening of a ceiling or a wall, the fixture comprising:

a) a light source housing including a canister and light socket, the light source housing configured and arranged to receive a light bulb;

b) a device mounting track configured and arranged to removably couple a plurality of interconnecting devices to the light fixture, wherein the device mounting track comprises a voltage rail configured to electrically couple one or more of the plurality of interconnecting devices; and c) a smart hub coupled to the canister and configured and arranged to communicate with and power one or more of the plurality of interconnecting devices removably coupled to the device mounting track, wherein the smart hub is configured to interconnect the plurality of interconnecting devices by sharing data between the devices.

2. The fixture of claim 1 wherein the device mounting track is an extension to any recessed light mounted in the ceiling or the wall.

3. The fixture of claim 1 wherein the device mounting track is recessed into the ceiling or the wall to give either the ceiling or the wall the appearance of a continuous surface.

4. The fixture of claim 1, wherein the device mounting track further includes a data rail configured and arranged to communicatively couple the one or more of the plurality of interconnecting devices with the smart hub without directly wiring the interconnecting devices to the smart hub.

5. The fixture of claim 4, further comprising a plurality of interconnected devices, wherein each of the interconnected devices is communicatively coupled to the data rail.

6. The fixture of claim 1, wherein the one or more of the plurality of interconnecting devices are removeably secured to the device mounting track via one or more mechanical retainers.

7. The fixture of claim 1, wherein the device mounting track consists of one or more ferromagnetic metals; the device mounting track is configured to use magnetic force to secure the interconnecting devices to the fixture.

8. The fixture of claim 1, wherein the device mounting track is recessed relative to the ceiling or wall.

9. The fixture of claim 1, wherein the device mounting track is configured to be an add-on to an already installed recessed light.

10. The fixture of claim 1, further including a device mounting track cover configured and arranged to cover the device mounting track when not being used by one of the plurality of interconnecting devices or to cover at least part of the device mounting track and/or one of the interconnecting devices.

11. The fixture of claim 1, wherein the smart hub is configured to provide data and power to the one or more of the plurality of interconnecting devices via the device mounting track for devices.

12. The fixture of claim 1, wherein the smart hub includes a signal and data processor to consolidate tasks.

13. The fixture of claim 1, wherein the plurality of interconnecting devices is one or more of the following: an audio system or a component thereof, a surveillance system or a component thereof, a video projection system or a component thereof, motion detection sensor, air quality senor, or a hazard detector.

14. The fixture of claim 1, wherein the smart hub further comprises an analog to digital converter.

15. The fixture of claim 1, wherein the smart hub is configured to share data between the devices through use of a wireless protocol.

* * * * *